US006305684B1

(12) United States Patent
Lightner et al.

(10) Patent No.: US 6,305,684 B1
(45) Date of Patent: Oct. 23, 2001

(54) FEED ROLLERS WITH REVERSING CLUTCH

(76) Inventors: Werner R. Lightner, 4980 N. Marine Dr. Apt. 932, Chicago, IL (US) 60640; Donald J. Stefanich, Jr., 1305 Maple Ave., Lisle, IL (US) 60532; Jim T. Russo, 185 Kathleen La., Chicago Heights, IL (US) 60411; Jose S. Pioquinto, 382 Oak Trails Rd., Des Plaines, IL (US) 60015; Paul E. Brodzik, 23076 N. Richards Ct., Prairie View, IL (US) 60069

( * ) Notice: Subject to any disclaimer, the term of this patent is extended or adjusted under 35 U.S.C. 154(b) by 0 days.

(21) Appl. No.: 09/262,768

(22) Filed: Mar. 4, 1999

(51) Int. Cl.[7] ..... B65H 3/52
(52) U.S. Cl. ..... 271/122; 271/127
(58) Field of Search ..... 271/110, 122, 271/127

(56) References Cited

U.S. PATENT DOCUMENTS

| | | | | |
|---|---|---|---|---|
| 3,640,524 | | 2/1972 | Fredrickson | 271/36 |
| 3,885,782 | * | 5/1975 | Wright et al. | 271/1 X |
| 3,929,327 | * | 12/1975 | Olson | 271/250 |
| 3,937,453 | * | 2/1976 | Hickley et al. | 271/4 X |
| 4,113,245 | | 9/1978 | Colglazier et al. | 271/10 |
| 4,436,298 | * | 3/1984 | Donner et al. | 271/10 X |
| 4,752,432 | * | 6/1988 | Freeman | 271/35 X |
| 4,822,021 | | 4/1989 | Giannetti et al. | 271/35 |
| 4,844,435 | | 7/1989 | Giannetti et al. | 271/10 |
| 5,006,903 | | 4/1991 | Stearns | 355/308 |
| 5,007,627 | | 4/1991 | Giannetti et al. | 271/35 |
| 5,039,080 | * | 8/1991 | Kato et al. | 271/122 |
| 5,062,599 | | 11/1991 | Kriegel et al. | 271/35 |
| 5,106,071 | * | 4/1992 | Grahm | 271/116 X |
| 5,190,277 | | 3/1993 | Rahman et al. | 271/35 |
| 5,209,464 | | 5/1993 | Bermel et al. | 271/35 |
| 5,344,134 | * | 9/1994 | Saeki et al. | 271/122 |
| 5,386,913 | | 2/1995 | Taylor | 209/583 |
| 5,416,570 | | 5/1995 | Kondou | 355/321 |
| 5,472,182 | | 12/1995 | Han | 271/3.13 |

(List continued on next page.)

FOREIGN PATENT DOCUMENTS

| | | | | |
|---|---|---|---|---|
| 000575919 A1 | * | 12/1993 | (EP) | 271/122 |
| 2 378 706 | | 8/1978 | (FR) . | |
| 0006854 | * | 1/1983 | (JP) | 271/122 |
| 01117142 | | 5/1989 | (JP) . | |
| 0181633 | * | 7/1989 | (JP) | 271/122 |
| 0081845 | * | 3/1990 | (JP) | 271/122 |
| 03003839 | | 1/1991 | (JP) . | |

OTHER PUBLICATIONS

Copiscan 4000 Series, The Copiscan 4040D plus high performance production capabilities on every workgroup desktop. Bell & Howell Scanner Division, 1997 Bell & Howell Scanner Division.

Fallon, et al. "Sheet Feeding Apparatus," IBM Technical Disclosure Bulletin 19(7):2440–2441 (Dec. 1976).

*Primary Examiner*—Christopher P. Ellis
*Assistant Examiner*—Ken Bower
(74) *Attorney, Agent, or Firm*—McAndrews, Held & Malloy, Ltd.

(57) ABSTRACT

The invention is a sheet feeder for engaging and removing a sheet of paper or other material from a stack and feeding it along a path. The sheet feeder can include a sheet separator designed for advancing the engaged sheet while retarding any adjacent sheets. The separator has a driven advancing roller nipped with a driven retarding roller coupled to its drive by a friction clutch. The clutch normally slips and permits the retarding roller to be driven forward by the advancing roller when one or no sheets are engaged between the advancing and retarding rollers. The clutch engages and drives the retarding roller backward so long as a multifeed of two or more sheets is engaged between the advancing and retarding rollers.

4 Claims, 11 Drawing Sheets

U.S. PATENT DOCUMENTS

| | | | | |
|---|---|---|---|---|
| 5,474,287 | * | 12/1995 | Takahashi | 271/10.13 X |
| 5,497,250 | | 3/1996 | Kawashima | 358/498 |
| 5,502,556 | | 3/1996 | Yamada | 355/320 |
| 5,510,909 | | 4/1996 | Morikawa et al. | 358/498 |
| 5,532,847 | | 7/1996 | Maruyama | 358/498 |
| 5,547,179 | | 8/1996 | Wilcox et al. | 271/3.2 |
| 5,564,689 | * | 10/1996 | Fukube | 271/122 |
| 5,568,281 | | 10/1996 | Kochis et al. | 358/475 |
| 5,574,274 | | 11/1996 | Rubley et al. | 250/208.1 |
| 5,598,271 | | 1/1997 | Ohtani | 358/296 |
| 5,610,731 | | 3/1997 | Itoh | 358/496 |
| 5,638,181 | | 6/1997 | Kubo et al. | 358/296 |
| 5,673,124 | | 9/1997 | Kaji et al. | 358/474 |
| 5,680,204 | | 10/1997 | Ferrara | 355/311 |
| 5,689,765 | | 11/1997 | Nishinozono | 399/81 |
| 5,692,743 | | 12/1997 | Yano et al. | 271/121 |
| 5,705,805 | | 1/1998 | Han | 250/204.1 |
| 5,710,967 | | 1/1998 | Motoyama | 399/377 |
| 5,715,500 | | 2/1998 | Nakazato et al. | 99/124 |
| 5,734,483 | | 3/1998 | Itoh | 358/496 |
| 5,760,412 | | 6/1998 | Yang et al. | 250/559.4 |
| 5,887,866 | * | 3/1999 | Yamauchi et al. | 271/116 X |
| 5,897,258 | | 4/1999 | Wen et al. | 400/579 |
| 5,901,951 | * | 5/1999 | Yamauchi | 271/10.11 X |
| 5,921,539 | | 7/1999 | Westcott et al. | 271/10.03 |
| 5,927,706 | * | 7/1999 | Hiori et al. | 271/117 X |
| 5,975,516 | * | 11/1999 | Maruchi et al. | 271/10.12 X |
| 6,042,099 | * | 3/2000 | Takagishi | 271/2 X |

* cited by examiner

IN-FEED SKIMMER ROLLER MODULE, 21

FEED ROLLERS WITH REVERSING CLUTCH

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

The present invention relates to automated sheet feeder apparatus for scanning equipment and the like, and more particularly to a configuration that facilitates document separation and spacing for use with universal document feeder apparatus associated with high-speed image scanning equipment requiring high-volume document throughput.

Automated high-speed image scanning equipment utilizes an imaging device to scan the images from an input or source document. Such equipment must feed and transport documents to the imaging device quickly, smoothly, and automatically, and must be trouble-free. The feeding equipment must quickly and smoothly feed each original document or individual sheet from the backlog queue of input or source documents waiting to be scanned to the transport apparatus. The transport apparatus then brings each document or sheet to the imaging device. To achieve high-volume throughput, the high-volume feeder apparatus must be able to supply the individual documents or sheets in a spaced relationship to the input section of the transport apparatus in a manner that is completely reliable and trouble-free.

A problem associated with high-speed image scanning equipment found in the prior art is that the individual source or input documents commonly are not standardized. They vary in shape and size, and come in a variety of different thicknesses (e.g., sheets ranging from an onionskin thickness to thick card stock). This mandates that each non-uniform document be processed or handled in a uniform manner.

Another related problem is that, in the majority of instances, the input or source document is an original document or a document that is not easily replaced. It becomes imperative that the document feed mechanism not damage any of the source documents under any circumstances.

A persistent problem found in the prior art is the more or less random feeding of multiple documents at one time by the document feed mechanism, rather than a single sheet. The problem is commonly referred to, by those skilled in the art, as the "multi-feeds" problem. The multi-feeds problem is made even more critical when a high-volume document throughput is required for high-speed image scanning equipment and the like. In such situations, the individual source documents waiting to be scanned are in a stack, and either the top or bottom document is fed sequentially to the image scanner by the document feed mechanism. A number of variables are supposedly responsible for this negative result, including but not limited to the weight of the skimmer roller assembly (which rests on top of the first document in the stack of documents waiting to be scanned), the underlying dynamics of the friction that the bottom and top sheets experience as the document feed mechanism accelerates the next sheet from the stack forward, and the spacing required between individual documents as documents enter the document feed mechanism and are sequentially processed.

Yet another common problem with certain document feed mechanisms for high-speed image scanning equipment and the like found in the prior art is that, over time, this equipment will occasionally cause bottlenecks and/or jam-ups of downstream equipment, having an obvious negative effect on overall document throughput. Sometimes the problem can be corrected by timely maintenance of the document feed mechanism. High-speed image scanning equipment that provides for high-volume document throughput necessitates a reliable document feed mechanism that is easy to maintain and is capable of fulfilling document throughput requirements.

A particular prior device currently in use employs a relatively narrow skimmer roller at the entrance to the feeder together with an adjustable separate weight that causes the skimmer roller to grip the paper. The prior device also uses a pair of counter-rotating shafts with interleaved roller portions that are designed to advance the top page while retarding any adjacent or lower pages. Finally, in that device there is space between the skimmer roller and the interleaved forwarding and reversing rollers. Sheets being fed sometimes buckle or bunch up in that space. The counter-rotating shafts are set an adjustable distance apart. The inventors have found that this arrangement results in paper jams and multifeeds when stacks of documents with different thicknesses are introduced.

Another prior commercial device utilizes a driven advancing roller nipped with a retarding roller coupled by a brake assembly to a fixed shaft. The advancing roller urges one face of the sheet forward, while the retarding roller acts as a drag on the opposite face of the sheet. If multiple sheets pass between the advancing and the retarding rollers, the advancing roller will urge the first sheet forward and the retarding roller will drag on the other sheet. Since the friction between the retarding roller and the sheet is higher than the friction between two sheets, the retarding roller will prevent the passing of the lower sheet. While this is not a "reversing" roller per se, but rather a simple "drag" on the lower of two adjacent sheets, it tends to separate the two while the upper sheet passes through the gap under the drive of the advancing roller. The inventors have found that this invention, however, could not resolve the problem of multi-feed of three or more sheets at a time.

Also in the prior art are various arrangements for the retarding roller. The first of these is an earlier development in which a retarding roller is mounted on a fixed shaft and has a peripheral rubber surface that frictionally engages the peripheral outer surface of the advancing roller or the sheet between the rollers. A tubular coil spring is attached at one end to the retarding roller and wrapped around the fixed shaft. When the advancing roller moves in the forward direction, the friction between the outer surfaces of the retarding and advancing rollers urges the retarding roller forward, thus tending to turn the coil spring on the fixed shaft. This torsional motion tensions the coil spring and reduces its diameter. The coil spring constricts about the fixed shaft, acting as a brake. When more than one sheet is passed between the rollers, the advancing roller pushes the top sheet in the forward direction. The retarding roller is uncoupled from the advancing roller, as the two or more feed sheets between the advancing and retarding rollers slip relative to each other. Uncoupling the rollers allows the spring to unwind. The unwinding spring momentarily turns the retarding roll backward for about one revolution. An example of this mechanism can be found in Bell & Howell's Scanner Model No. 0101276 and 0101300. This arrangement can correct the misfeeding of two sheets but not necessarily a stack of three or more misfed sheets. The reverse rotation or recoil of the retarding roller is limited, so the retarding effect is limited too.

BRIEF SUMMARY OF THE INVENTION

The improvements of the present invention address the drawbacks and deficiencies of the prior art in a manner that facilitates high-speed image scanning of individual source documents irrespective of the size or thickness of the specific source document being scanned or processed.

Accordingly, several objects of the invention are to provide an improved feeding mechanism that is light in weight and that maintains a predetermined spaced relationship between the individual documents that are removed from the stack in order to attain high-volume document throughput.

Another object of the present invention is to provide a document feed mechanism having a feeding mechanism that facilitates high-speed image scanning of individual source documents by the elimination of the feeding of multiple sheets of source documents at one time.

Another object of the present invention is to provide a document feed mechanism which facilitates high-speed image scanning of individual source documents that is more reliable than the apparatus found in the prior art.

Yet another object of the present invention is to allow a separation of a stack of three or more sheets, facilitating high-speed image scanning of individual source documents.

A still further object of the present invention is the provision of a skimmer that provides a more reliable separation of a top sheet in a stack of sheets. At least one of these objects is achieved, in whole or in part, by the present invention.

The invention is a sheet separator. The separator can be used, for example, as part of a sheet feeder for engaging and removing sheets of paper or other material from one end of a stack of sheets and feeding the engaged sheets one by one edgewise along a feed path. The sheet separator includes a sheet path (along which a sheet or multifeed having first and second surfaces is passed), an advancing roller, a retarding roller, a drive, and a friction clutch.

The advancing roller is positioned to drive forward the first surface of a sheet in the sheet path. The retarding roller is positioned to drive back the second surface of a sheet in the sheet path. A drive is provided to rotate the retarding roller backward when the drive is engaged. A friction clutch is provided to engage the drive with the retarding roller.

The clutch normally slips and permits the retarding roller to be driven forward by the advancing roller when one or no sheets are engaged between the advancing and retarding rollers. The clutch slips when one or no sheets are engaged because the friction between either roller and the sheet, or directly between the rollers, is great enough to make the clutch slip. The clutch engages and drives the retarding roller backward when a multifeed of two or more sheets is engaged by the advancing and retarding rollers. The clutch engages when a multifeed enters because the sheet-to-sheet friction between two sheets interposed between the rollers is too low to cause the clutch to slip. The advancing roller thus engages and advances the top sheet and the retarding roller then engages and retards the bottom sheet of a multifeed of two or more sheets.

One particular advantage of the invention is that it can separate a multifeed of three or more sheets passed between the advancing and retarding rollers. The retarding roller drive can operate continuously (in one embodiemt of the invention). The friction clutch can remain engaged for as long as a multifeed of more than one sheet remains between the advancing and retarding rollers. The friction clutch remains engaged so long as a multifeed persists because sheet-to-sheet slippage between two or more sheets disengages the advancing roller from the retarding roller.

The retarding roller will at least retard (and in one embodiment move back) the lowermost sheet of a multifeed the entire time the friction clutch is engaged. The retarding function will therefore continue to arrest or back up all the sheets but the top one (and particularly the lowermost sheet at any given moment, though intermediate sheets may also be driven back to some degree) until only the top sheet of the now-disassembled multifeed remains between the rollers. Only then does the advancing roller engage the retarding roller, thus disengaging the friction clutch, thus causing the retarding roller to rotate in a forward direction and pass the top sheet.

DETAILED DESCRIPTION OF THE INVENTION

Figure 1:
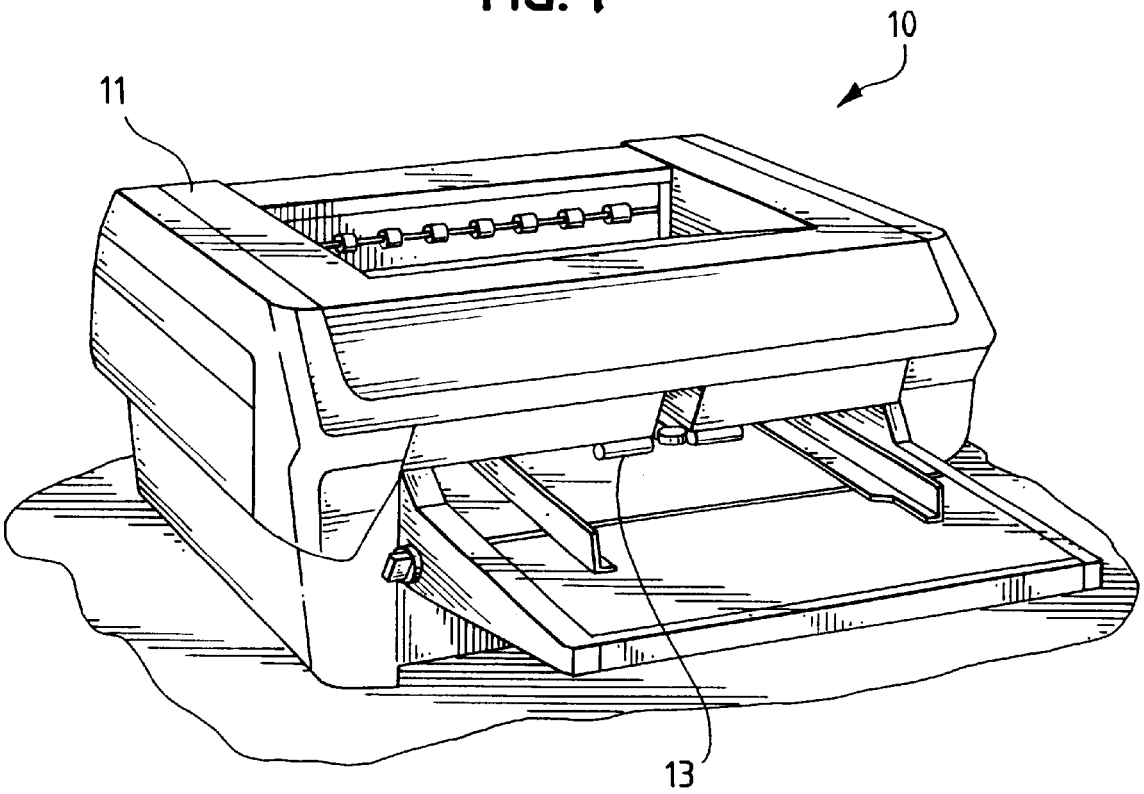
FIG. 1 is a perspective view of a document scanner with a document feeder attachment.

While the invention will be described in connection with one or more embodiments, it will be understood that the invention is not limited to those embodiments. On the contrary, the invention includes all alternatives, modifications, and equivalents as may be included within the spirit and scope of the appended claims. In the following description and the drawings, like reference numerals represent like elements throughout.

In accordance with the present invention, an improved document feed mechanism is described that facilitates reliable high-volume document throughput for associated image scanning equipment, and similar equipment and/or processes, irrespective of the varying thickness associated with input documents. It is designed to eliminate the feeding of multiple sheets (so-called "multifeeds" of several pages at one time) and to avoid damage to an individual input document or sheet (commonly referred to as "source document").

FIG. 1 shows one suitable environment of the invention: a high speed, commercial document scanner 10. Scanners of this type typically process continuous streams of paper, like stacks of checks. The scanner 10 has a document imaging assembly 11 and a document feed mechanism 13. The document feed mechanism 13 would also be useful for feeding sheets of material other than paper from a stack into apparatus for performing any of a wide variety of operations on the sheets.

A typical scanner assembly 11 of this type uses photoelectric detectors and photo imaging devices for digitally capturing the image from a moving piece of paper. The scanner may be capable of single-sided or double-sided image capture. A scanner assembly contains a linear series of charge coupled devices or the like, which traverse the path of the moving paper. The linear array is repetitively exposed to the light path and digitally "dumped" into memory to reformulate the image electronically in mass memory for display.

The document feed mechanism or sheet feeder 13 of the disclosed embodiment is approximately 15 inches (37 cm) wide (from its left and right side control knobs), 12 inches (31 cm) long, and 5 inches (12 cm) high and is relatively lightweight.

A Prior Document Feeder

Turning to FIGS. 2 through 5, the illustrated prior art sheet feeder 13 includes a skimmer 21 and a separator 19. The skimmer 21 engages and removes the outside or end sheet 44 from one end of a stack 43 of sheets and feeds the engaged sheet 44 edgewise along a feed path 14 which extends generally in the plane of the sheet 44 under the skimmer rollers 25, along the guide surface 15, and through the nip 58 of the separator 19. The separator 19 is spaced downstream along the feed path 14 from the skimmer 21 for advancing the engaged sheet 44 while retarding any adjacent sheets misfed along with the end sheet 44 intended to be fed.

The skimmer 21 is supported by and pivots in the vertical direction about a skimmer shaft 24 to facilitate the stacking of individual input documents into a single stack of input or source documents which are queued-up and positioned on the top surface of the document feed mechanism for image scanning or similar processing of each individual sheet or source document. Further, each individual input sheet or source document has an associated thickness, which may vary from one such sheet or source document to another. The paper-engaging portion of the skimmer roller assembly 21 is a first friction element 25—here, a pair of driven skimmer rollers 25 having generally cylindrical endless rotating peripheral surfaces carried on a stub shaft 16.

Figure 4:
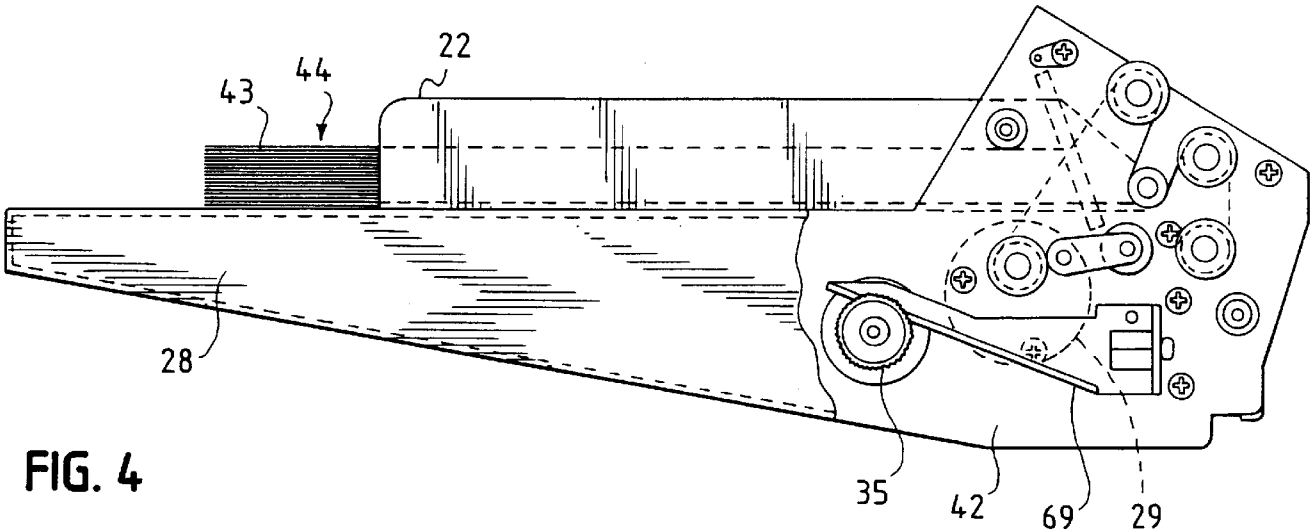
FIG. 4 is a right side elevational view, partially cut away, of the prior art assembly of FIG. 2.

The skimmer rollers 25 are brought into continuous contact (through gravity) with the topmost document or end sheet 44 of the input stack 43 (FIG. 4). The feeder could alternately be configured to feed from the bottom of the stack (as to allow additional sheets to be stacked while the sheet feeder is in operation.) In that event, the end sheet would be the bottom sheet of the stack. Since in the illustrated embodiment the roller assembly 21 desirably bears on the input stack 43 with more force than its own weight provides, an additional weight (not shown) is provided on the skimmer roller assembly to achieve more positive gripping of the top document from the input stack 43.

The construction of the skimmer rollers 25 maintains the correct pressure or force continuously on the top surface of the top sheet or source document 44 of the stack 43 of input documents by the skimmer rollers during operation of the document feed mechanism. In the prior device depicted in FIGS. 1–5, approximately half of each skimmer roller is manufactured from a hard, smooth, relatively low friction coefficient, slippery material, such as steel, plastic or some other similar materials. The other half of each skimmer roller is manufactured from a much softer material having a relatively high friction coefficient, such as polyurethane rubber or a similar material.

During operation of the document feed mechanism, the skimmer rollers make contact with the top surface of the topmost sheet or source document in the stack waiting to be processed. The rubber portion of each skimmer roller will tend or act in a manner to intermittently urge the topmost sheet or source document in the stack of input documents waiting to be processed forward into the document feed mechanism. The plastic or steel (or other similar material) portion of each skimmer roller will tend to act in a manner to facilitate slight slipping on the top surface of the topmost document of the stack of input documents.

Figure 2:
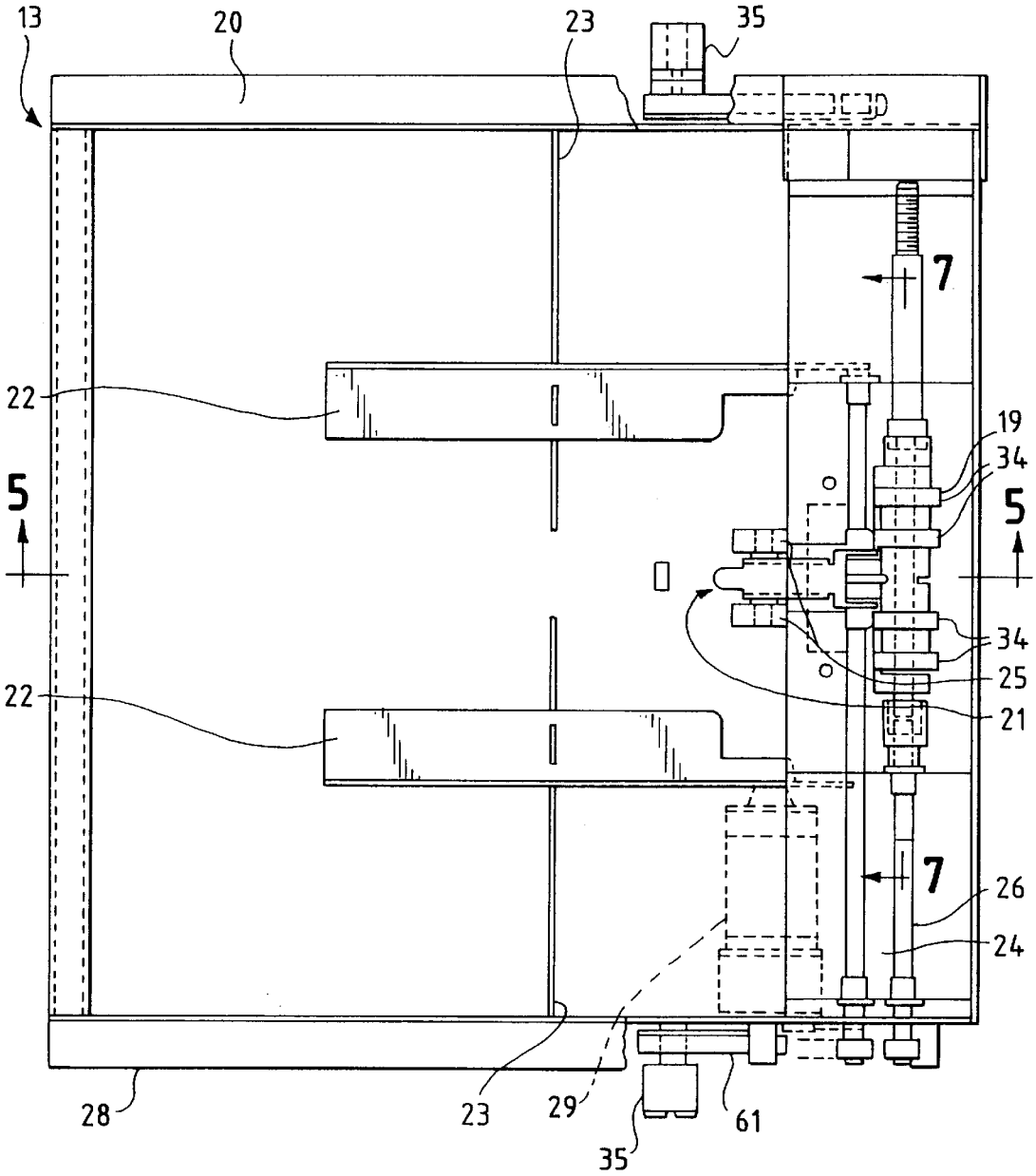
FIG. 2 shows a top plan view of a prior art feeder tray (with the side covers and overlying structure cut away).

The separator 19 includes a series of axially spaced forwarding rollers 34 (four are shown in FIG. 2) carried on a common shaft 26 and an interleaved series of axially spaced reversing rollers 36 (best seen in FIG. 5) carried on a parallel common shaft 56. The concept of interleaving forwarding and reversing rollers 34 and 36, per se, is shown best in FIG. 7 in connection with the present invention.

Returning to FIGS. 2 and 5, the shafts 26 and 56 rotate in the same direction—counterclockwise as shown in FIG. 5. Therefore, where the bottoms of the rollers 34 interleave with the tops of the rollers 36, their facing surfaces are moving in opposite directions. The bottoms of the forwarding rollers 34 are moving from left to right (in the feeding direction) and the tops of the reversing rollers 36 are moving from right to left (contrary to the feeding direction), all with reference to FIG. 5.

The opposing forwarding and reversing rollers, 34 and 36 respectively, are each made of different materials to enable the forwarding rollers 34 to have more friction on the input sheet than the reversing rollers 36. Thus, if only one sheet is presented, the net result is forward motion of the presented sheet through the forwarding and reversing rollers 34 and 36. However, if two or more sheets are presented, the properly feed top sheet 44 is engaged by the forwarding rollers 34 only, and the misfed bottom sheet is engaged by the reversing rolls 36 only. This advances only the properly fed sheet and reverses the travel of any misfed sheets.

Adjustable paper guides 22 (left and right) are adjustable along a transverse slot 23 to the appropriate width of the input stack 43. The guides 22 maintain the documents in a stacked relationship below the skimmer rollers 25, which are in continuous contact with the top document of the input stack 43.

Figure 5:
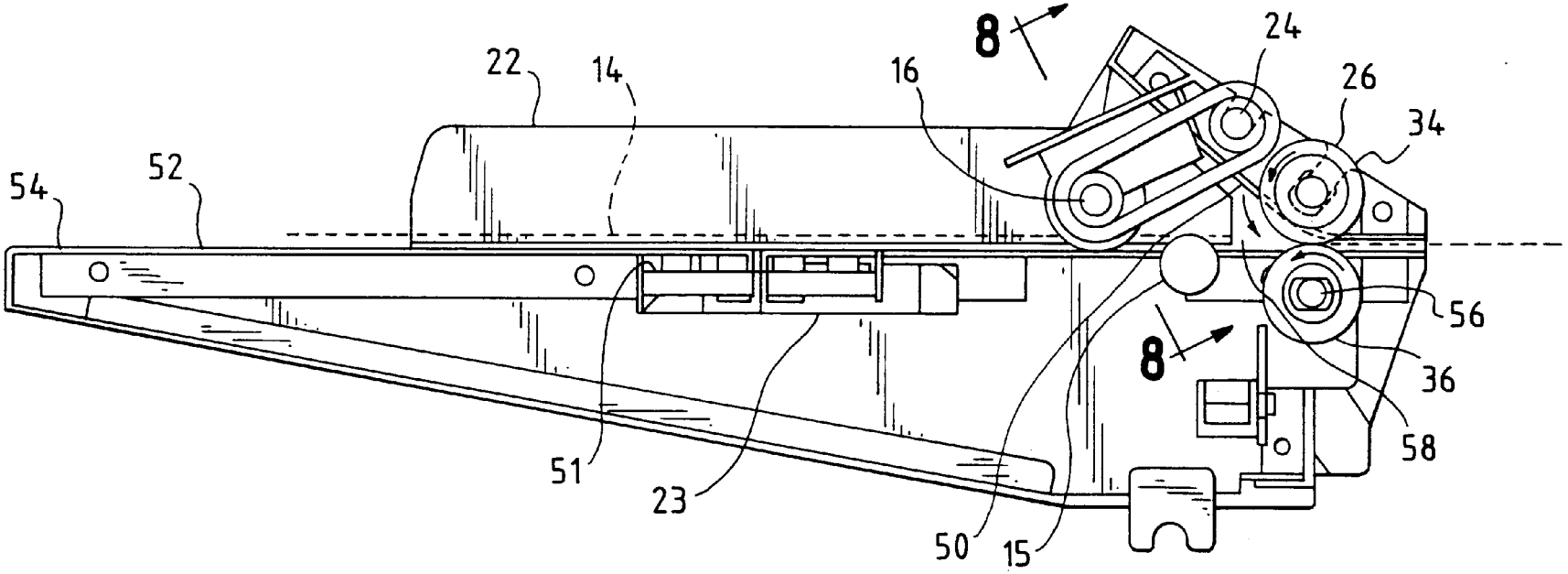
FIG. 5 is a section taken along lines 5—5 of FIG. 2, illustrating the prior art feed mechanism.

Cooperating shafts 24, 26 and 56 (see FIG. 5) provide the necessary conventional drive mechanics to the skimmer rollers 25 and to the forwarding and reversing rollers 34, 36 (see FIG. 5), respectively, that are associated with the document feed mechanism nip area 58 (see FIG. 5). An electric motor 29 (see FIG. 2) provides the necessary driving force for all the different parts driven by a drive belt 31 (see FIG. 4), including the cooperating shafts 24, 26 and 56.

To avoid multi-feed problems, the forward and reverse roller mechanism 34 and 36 should have the rollers 25 spaced axially from each other, forming a gap that can be adjusted. This was resolved in the prior art by using a control knob 35 that adjusts the position of the lower or reversing rollers relative to the upper or forwarding rollers.

Figure 3:
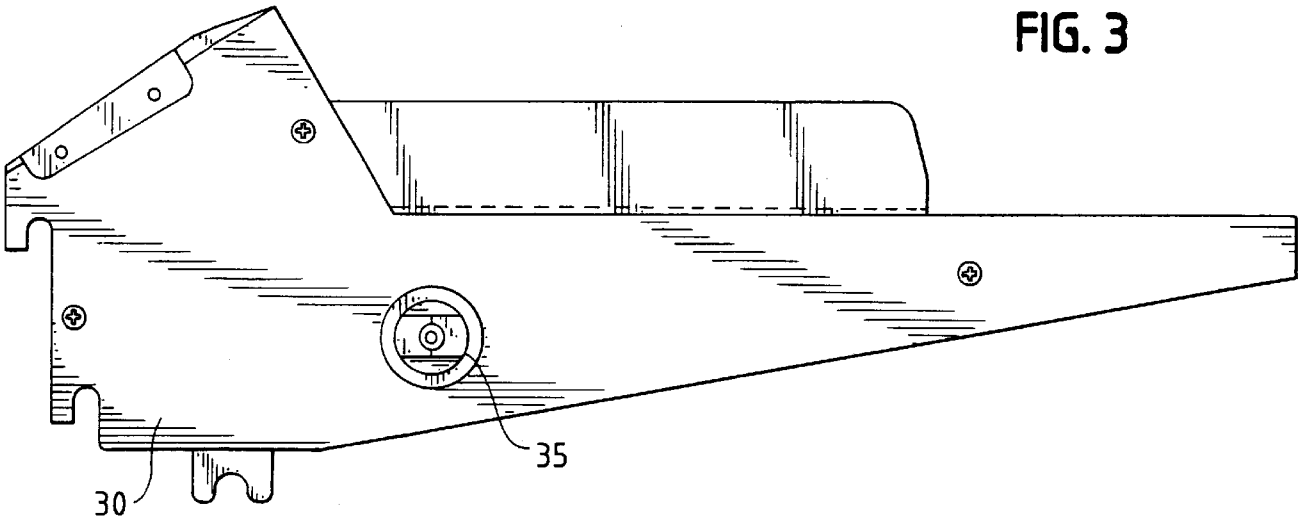
FIG. 3 is a left side elevation of the prior art assembly of FIG. 2.

Turning to FIG. 3, there is shown a left side panel 30 and the control knob 35. The left side panel 30 provides left side stability and lateral rigidity to the document feed mechanism 13, and facilitates attachment of the left-side exterior side cover 20 (see FIG. 2) to the document feed mechanism 13. The control knob 35 is used to adjust spacing between the forwarding and reversing rollers 34 and 36 (see FIG. 5). A variable to the successful operation of the document feed mechanism 13 is the gap or space existing between the forwarding and reversing rollers 34 and 36. The forwarding and reversing rollers 34, 36 are adjustable with respect to the interleaving of the rollers during operation of the document feed mechanism 13. Turning the control knob 35, a spacing arm 69 moves a support bracket that supports the drive shaft 56 of the reversing rollers 36 (see FIGS. 4 and 5). This pivoting adjusts the spacing between the forwarding and reversing rollers 34 and 36.

Turning now to FIG. 4, the conventional feeder includes a right side panel 42 that provides right side stability and lateral rigidity to the document feed mechanism 13 and facilitates attachment of the right-side exterior side cover 28 to the document feed mechanism 13. To provide the correct positioning and alignment of numerous piece parts of the document feed mechanism 13, the right side panel 42 contains numerous holes, cutouts and/or otherwise keyed areas associated therewith.

FIG. 5 is a cross sectional view of the prior art feeder taken along the lines 5—5 of FIG. 2, and best shows the operation of the feeder. Shown there is a flat feeder tray 52 having a feeder tray lip 54 at one end. Adjustable paper guides 22 are internally supported by a side guide support 51 (one support for each side). During operation of the document feed mechanism, the skimmer rollers 25, 26 are in continuous contact with the top surface of the topmost sheet in the stack of input documents. Whenever required, a side guide cover 23 can be removed to facilitate interior access to the adjustable paper guide 22 and its associated apparatus.

In operation, the skimmer rollers 25, 26 take the top sheet from the input stack 43 and drive this sheet into the stationary guide chute 50 located in front of the document feed mechanism nip area 58 associated with the document feed mechanism 13. Upon making initial contact with the stationary guide chute 50, the paper is driven downward until the input sheet enters the document feed mechanism nip area 58 of the document feed mechanism 13. The moving paper then comes into contact with two opposing rollers, namely the forwarding rollers 34 and the reversing rollers 36. The forwarding rollers 34 and the reversing rollers 36 are radially interleaved or overlapped and axially displaced so at least some of the forwarding rollers pass between the reversing rollers and vice versa. The forwarding rollers 34 and reversing rollers 36 rotate in the same direction (counterclockwise in FIG. 5), and thus work in opposition respecting paper or other sheets fed between them. The forwarding rollers 34 advance the top sheet and the reversing rollers 36 arrest the progress of any additional sheets.

THE PRESENT INVENTION

FIGS. 6–12 illustrate the improvements that have been made in connection with the present invention. In general, only selected components that have been modified are shown. For the remaining components of the system reference is made to FIGS. 1–5 and to Bell & Howell's prior document feeding apparatus and published descriptions of such apparatus.

Figure 6:
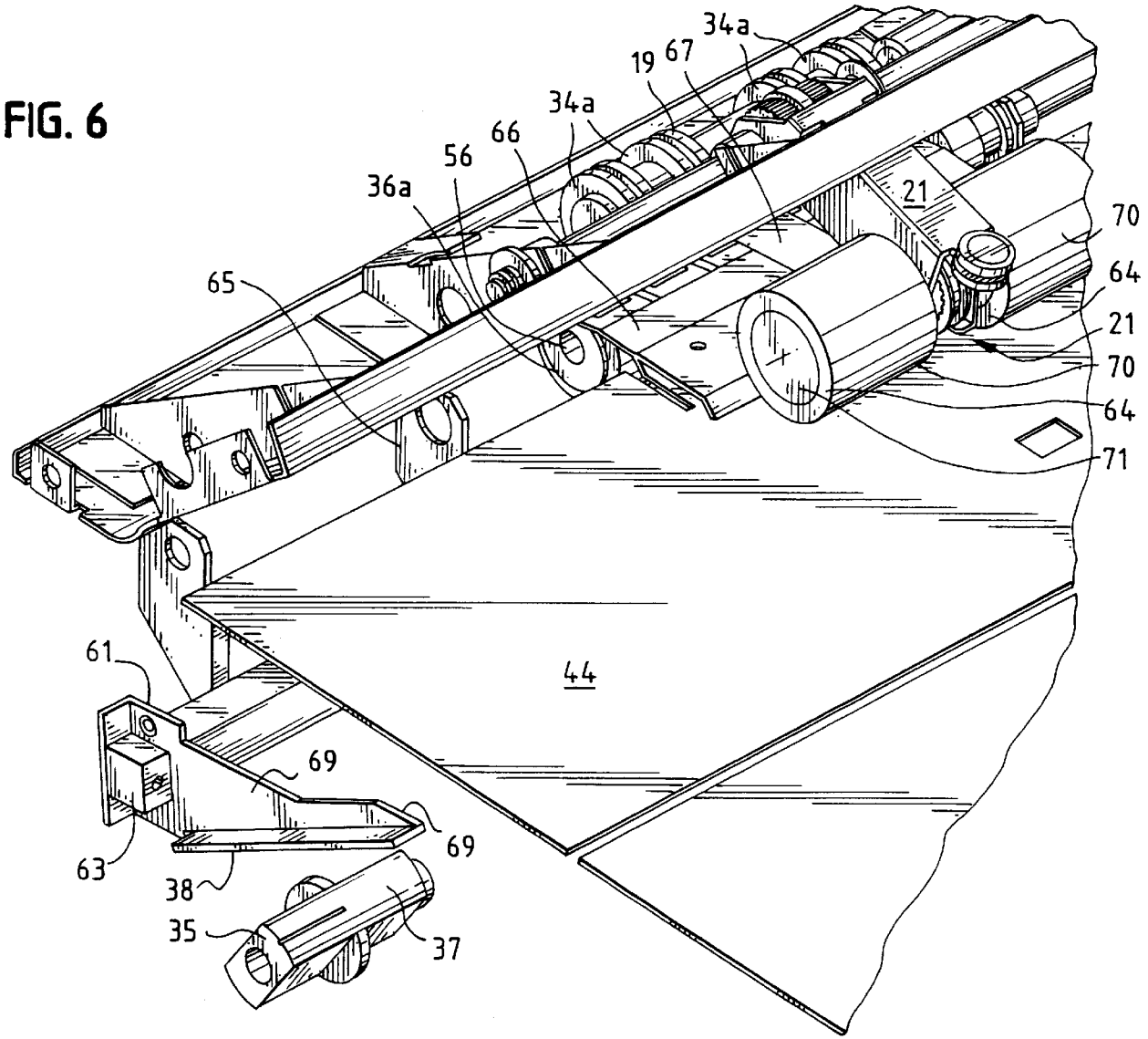
FIG. 6 is a diagrammatic perspective view of certain components of the modified feed assembly of the present invention.

FIG. 6 shows a skimmer roller assembly 21 of the present invention with relatively wide elastomeric rollers 64, as opposed to the relatively narrow skimmer rollers 25 used in the prior art. The generally cylindrical endless rotating surface 70 of each roller 64 can have an axial length longer than its circumference, in a preferred embodiment. This allows for a more positive gripping of the feed sheet. Also, the rubber used in the present invention can have a higher friction coefficient than the rubber used in the prior art. This eliminates the need for excessive weight to provide for a more positive gripping.

Figure 9:
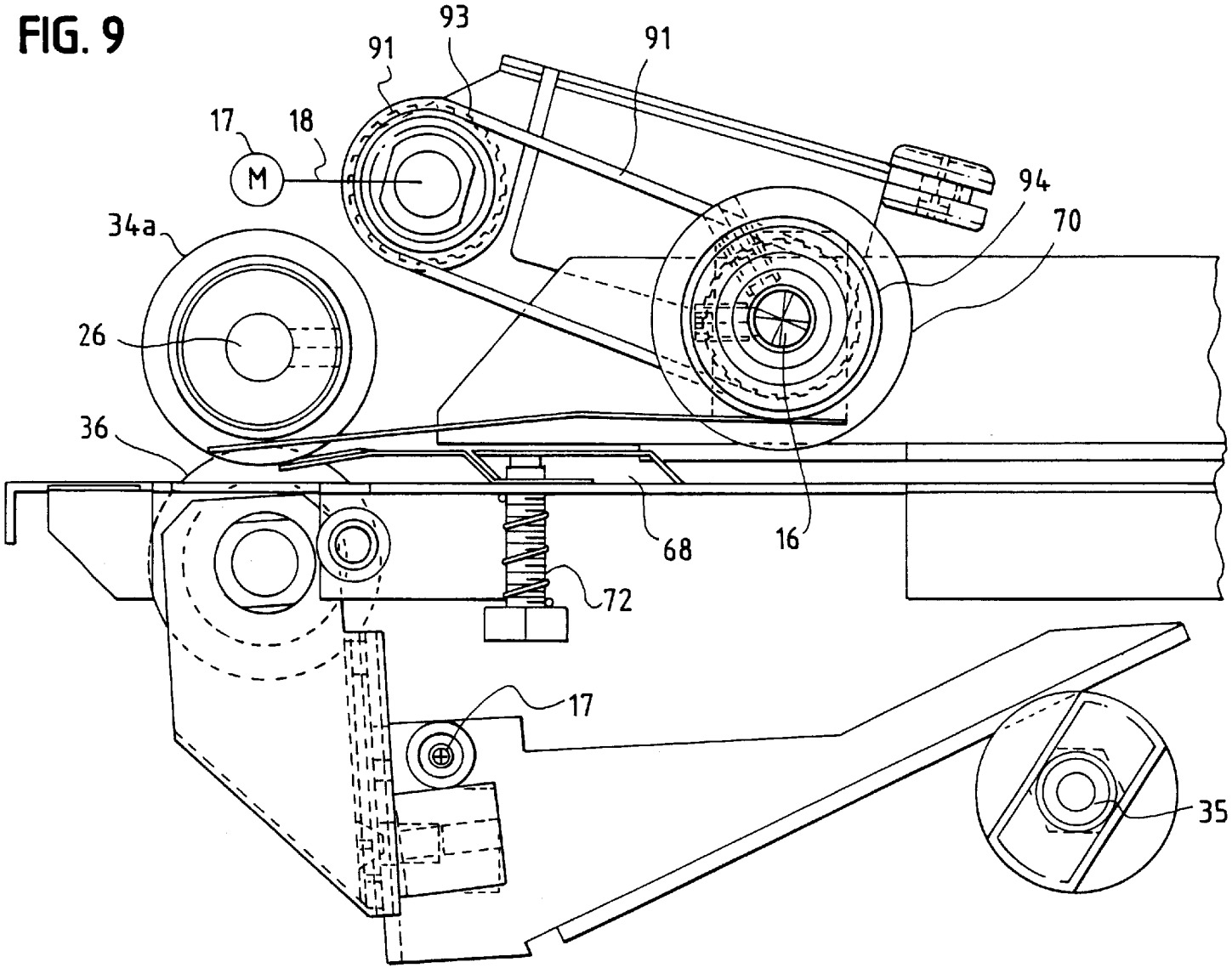
FIG. 9 is a view similar to FIG. 8 illustrating additional features and interactions.

FIG. 9 illustrates the improved skimmer roller mechanism 21 of the present invention. A toothed belt 91 is driven by a shaft 92, from the rotor schematically represented as 18 of the feeder drive motor schematicaly represented as 17. The prior belt drives for this purpose use belts that are smooth and prone to slipping which, in turn, produces uneven torque, and increases the multifeed problem. The toothed belt 91 engaging the timing sheaves 93 and 94 defines a positive drive engaging the rotor 18 (optionally through a further linkage) and engaging the rotating surface 70 (again, optionally through a further linkage) for turning the rotating surface 64 in timed relation to the rotation of the rotor 18. The timing sheave 93 is constrained to rotate in timed relation to the rotor 18. The timing sheave 94 is constrained to rotate in timed relation to the generally cylindrical endless rotating surface 70. The timing belt 91 is driven by the timing sheave 93 and drives the timing sheave 94. A gear drive, chain drive, crank drive, or other mechanical arrangement also would be suitable as timing drives.

"Timing drive" is used here synonymously to a "positive drive" to indicate a drive that resists slipping, and thus feeds at an even rate under ordinary circumstances. There is no need for a timing mechanism having the capacity to or arranged to synchronize different functions to achieve the purposes of the present invention.

The remaining driveshaft mechanics are similar to the prior apparatus. A suitable drive arrangement can readily be designed by a person having ordinary skill in this art.

Each of the wide elastomeric rollers 64 of the skimmer 21 defines a first friction element having a generally cylindrical endless rotating peripheral friction surface 70 rotatable about an axis 71 extending across and generally parallel to the feed path 14 on one side of the feed path 14. While in this embodiment the friction surfaces 70 are defined by rollers, other endless rotating peripheral friction surfaces, such as traction belts, are also contemplated for use as skimmers. The peripheral surface 70 of each roller 64 is positioned for engaging and advancing a single sheet 44 along the feed path 14. The rollers 64 take the top sheet or source document from the input stack 43 and drive the input sheet 44 into a guide mechanism located in front of the feeder nip area.

This action of the skimmer rollers 64 on the top surface of the topmost document 44 of the input stack 43 imparts to each top document 44 a gentle intermittent urging forward. This intermittent urging forward, in conjunction with the confining of the paper by the bumper 68 and the guide plates 66 and 81 (see FIG. 8), the downstream action of the forwarding rollers 34, and the action of the reversing rollers 36 prevents the feeding of multiple documents of the input stack 43 by the document feed mechanism 13. Buckling of the paper or damage to a source document because of a multifeed situation is reduced, minimized, or avoided altogether.

As the paper is pushed forward by the skimmer roller assembly, it is confined by the bumper 68 and the guide plate 66 on the one side, and the feeder spring guide plate 81 on the other. In the illustrated embodiment, the feeder spring guide 81 is a guide plate supported at least in part by and pivotable with respect to the support 16 for the skimmer rollers 25. The support 16 is a rotating shaft and the feeder spring guide 81 is mounted to be pivotable independent of the rotation of the rotating shaft 16.

Figure 7:
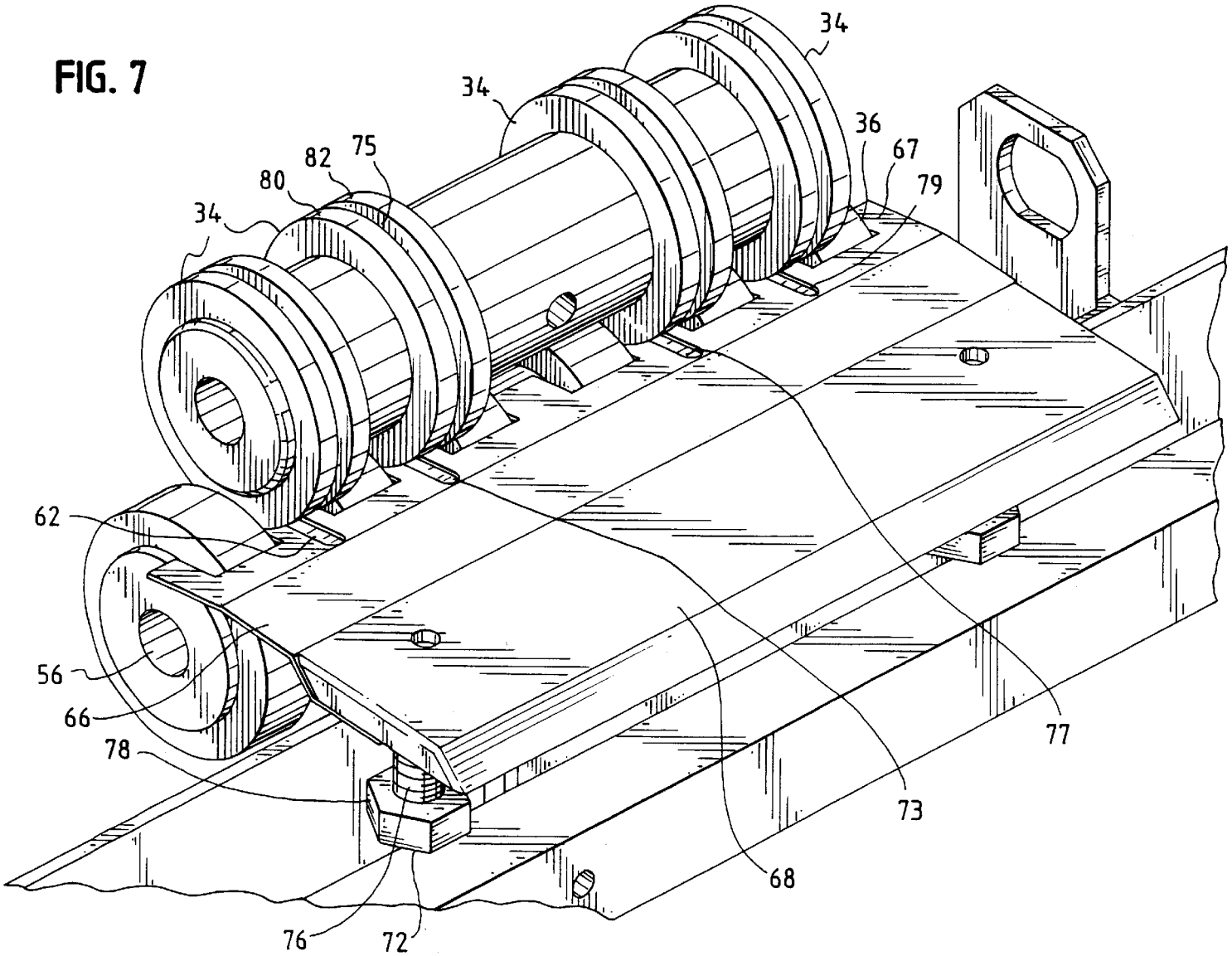
FIG. 7 is a more detailed, isolated perspective view of the improved advancing-retarding rollers, bumper and guide plate shown in FIG. 6.
Figure 8:
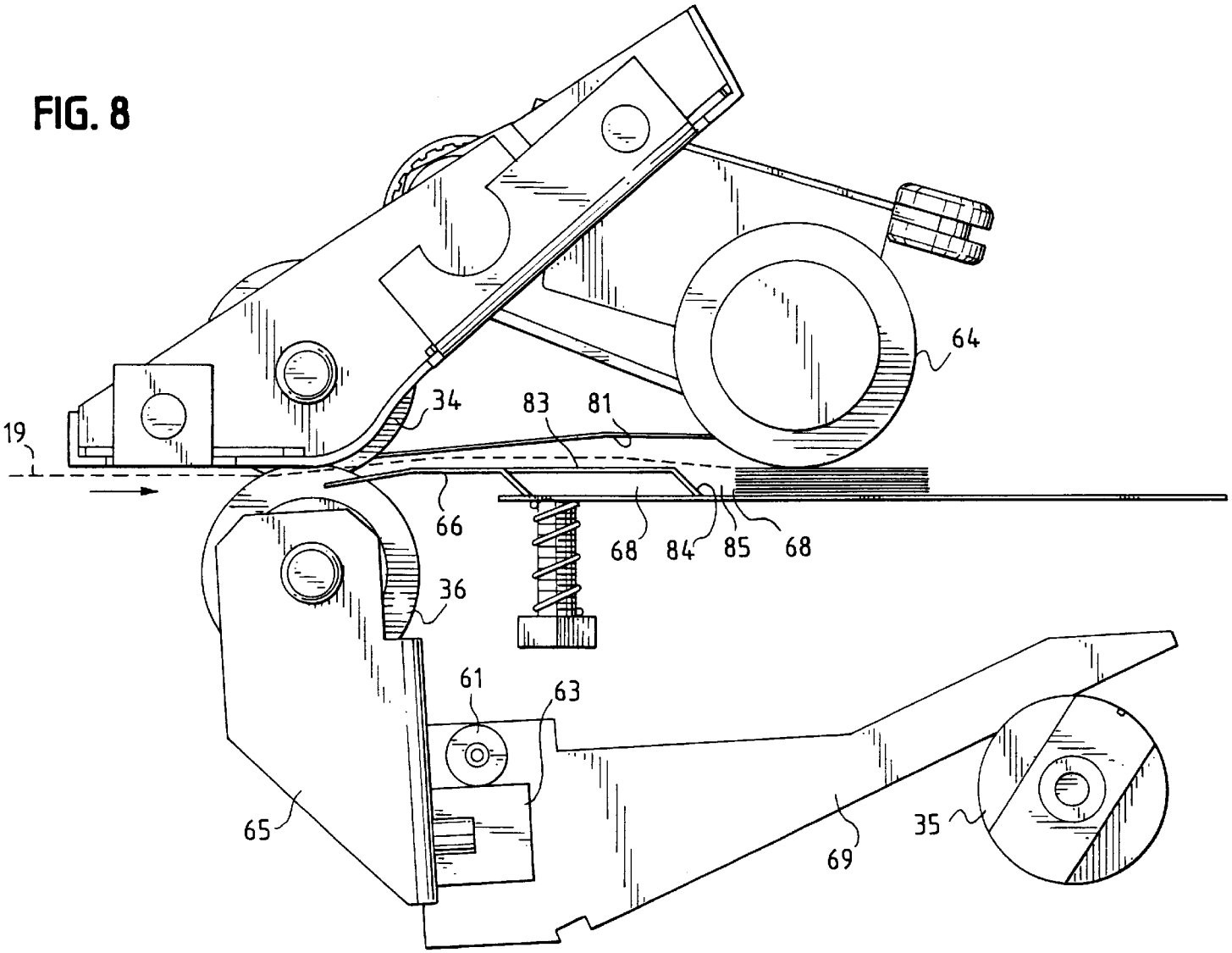
FIG. 8 is an isolated side elevational view of the major guide path components of the improved paper feed mechanism shown in FIGS. 6 and 7.

Turning to FIGS. 7 and 8, there are shown a bumper 68, a guide plate 66 and a supporting bolt 72 around which there is a spring that provides upward pressure to the bumper 68. FIG. 8 shows a guide plate 81, and both Figures show an improved separator 19 including forwarding rollers 34 and reversing rollers 36.

The bumper 68 extends across the feed path 14. The bumper 68 is a rectangular bar, box or tube supported by two springs that surround each of the bolts 72 underneath the bumper. The guide plate 66 is also supported by the same bolts 72 and extends to the document feed mechanism nip area 58. The bumper 68 has a guide surface 84 positioned to confront the leading edges such as 85 and 86 of the sheets of the stack 43 and to direct the leading edge 85 of an advancing engaged single sheet 44 away from the remainder of the stack. The guide surface 84 accomplishes this directing function because it is angled upwardly in the direction of the feed path 14 (to the left in FIG. 8). The top surface 83 of the bumper plate and the guide plate 66 are fixed relative to each other in this embodiment, and are substantially parallel, defining an extended guide plate extending from the downstream or upper edge of the surface 84 into the nip 58.

The guide plates 66 and 81 are positioned on opposite sides of the feed path 14. As will be seen, each guide plate 66 and 81 acts to prevent buckling or other damage to the sheet 44 being fed as it is forwarded through the space between the skimmer 21 and the separator 19, and between the two guide plates. Either one or both of the guide plates 66 and 81 can be used.

Turning now to FIG. 8, the wide elastomeric skimmer rollers 64 urge the paper into an intermediate area where it is confined by the guide plates 66 and 81 (see FIG. 8) closely adjacent the feed path 14. The guide plates 66 and 81 extend at least part way between the skimmer 21 and the separator 19 substantially parallel to the feed path 14 to guide the engaged single sheet 44 substantially along the feed path 14, preventing buckling of the engaged single sheet 44 perpendicular to the feed path 14.

The feeder spring guide 81 is attached to the skimmer roller assembly 21, is hinged about the axis of the skimmer roller assembly, and extends to the document feed mechanism nip area 58. The guide plates 66 and 81 converge as they extend to the left (in FIG. 8) in the direction of the feed path 14. The guide plate 81 is slightly bent to allow for a wide gap between the guide plate 81 and the bumper 68 at the entrance of the intermediate area and a narrow gap between the feeder spring guide 81 and a guide plate 66 near the downstream document feed mechanism nip area 58. The feeder spring guide 81 defines a guide plate on the opposite side of the feed path 14 with respect to the first guide plate 66.

The guide plate 66 has a "teeth-like" end with portions 67 that extend between the reversing rollers 36. Besides this "teeth-like" end, the guide plate contains intermediate fingers 73 supporting ribs 77. These fingers 73 fit the recessed channels 75 in the reversing rollers 36. The ribs 77 extend from the guide plate 66 radially into recessed circumferential channels 75, at least at some times while the feeder is in operation. The channels 75 divide the first peripheral surface of each forwarding roller 34 into two friction elements 80 and 82. A projecting friction surface or rib 77 is positioned to normally project into each recess 75, in this embodiment, though a one to one correspondence between ribs and forwarding rollers 34 is not required.

Each rib 77 is a projecting friction surface adjacent to and positioned on the opposite side of the guide path from the first peripheral surface of the rollers 34 for biasing an engaged single sheet 44 against the peripheral surfaces of the rollers 34 for advancement while separating any additional sheet positioned between the friction surface of the rolls 34 and the engaged single sheet 44. The ribs 77 thus function as another mechanism, independent of any reversing rollers such as 36, for cooperating with the forwarding rollers 34 to prevent the advance of misfed additional sheets along the feed path 14.

The guide plate 66 is biased toward the first peripheral surfaces defined by the rollers 34 by a spring 76 carried on a bolt 72 which is fixed by other structure (not shown). The spring 76 bears between the guide plate 66 and a fixed structure represented by the head 78 of the bolt 72.

The separator 19 illustrated here thus defines an axially alternating series of at least two axially spaced first friction elements, such as 80 and 82, and at least one second friction element 73 interposed between the friction elements 80 and 82. The second friction element 73 can be stationary with respect to travel along the feed path 14, and retards the progress of a sheet fed along the feed path 14.

After a fed sheet enters the document feed mechanism nip area 58, the ribs 73, which can be metallic, push the paper in the channels 75 of the improved forwarding rollers 34, which then force the paper into the gap between the improved forwarding rollers 34 and reversing rollers 36. The first and second friction elements 80/82 and 73 are axially offset from each other and the second friction element 73 is interleaved radially with respect to the first peripheral surfaces such as 80 and 82, thereby gripping the engaged sheet 44 between the first and second peripheral surfaces 34 and 73.

For the purposes of controlling the gap or space existing between the improved forwarding rollers 34 and the reversing rollers 36, the improved reversing rollers 36 are adjustable with respect to the meshing of the forwarding rollers 34 during operation of the document feed mechanism 13. The control knob 35 of FIG. 6 is pivotable about its axis and defines a cam having a lobe 37. Rotation of the knob 35 causes the lobe 37 to bear against a cam following surface 38 of a lever or spacing arm 69 which is rotatable about a pivot 61. Brackets 65 are secured to a square-section bar 63, which in turn is secured to the spacing arm 69. The brackets 65 support the shaft 56 (cut away in FIG. 6, shown in FIG. 7) supporting the reversing rollers 36. Bearing of the lobe 37 against the cam surface 38 thus rotates the spacing arm 69 and the shaft 63 counetclockwise about the pivot 61, rotating the shaft 56 back and down and thus reducing the degree of meshing between the forwarding and reversing rollers 34 and 36. Reverse rotation of the knob 35 has the opposite result. Springs or other structure can be provided to normally bias the cam follower surface 38 against the cam lobe 37.

For thinner sheets of source documents there can be provided a smaller gap between the forwarding and reversing rollers and, conversely, for thicker sheets of source documents a larger gap can be provided between the forwarding and reversing rollers. Accordingly, as required or whenever necessary, the control knob 35 is used to incrementally adjust the gap present between the forwarding and reversing rollers.

The recessed regions or channels 75 of the forwarding rollers 34 are formed deep enough to allow the fingers 73 to urge the paper into the channels 75 far enough to insure a substantial friction "grip" of the paper Turning to FIG. 8, upon entering the feeder nip area, the moving input sheet comes into contact with two opposing sets of rollers, namely, the improved forwarding rollers 34 and the reversing rollers 36, which function together in essentially the same way as described before. As before, the forwarding rollers 34 assist in moving any and all input documents of the input stack 43 in a forwarding direction. In the preferred embodiment, the improved forwarding rollers 34 are split into two axial portions to accommodate the intermediate finger assembly 73 that biases the paper into a more positive gripping by the improved forwarding rollers 34. The forwarding rollers are made of rubber or another elastomer material, and molded securely to an interior aluminum hub. This "channel" 75 fits each of the fingers of the intermediate finger assembly 73 that extend from the guide plate 66 to ensure more positive friction force. In the preferred embodiment, the size of the channel is 0.06 inches (1.5 mm) in width and a similar depth.

The reversing rollers 36 rotate more slowly, but in the same direction as the forwarding rollers 34. The reversing rollers 36 are harder and engage paper or other sheets with less friction than the forwarding rollers 34 impart, which helps them retard any sheets other than the topmost sheet 44 gripped by the forwarding roller. The reversing rollers 36 and improved forwarding rollers 34 are axially spaced and interleaved, as before. More reversing rollers 36 than before are provided.

Figure 10:
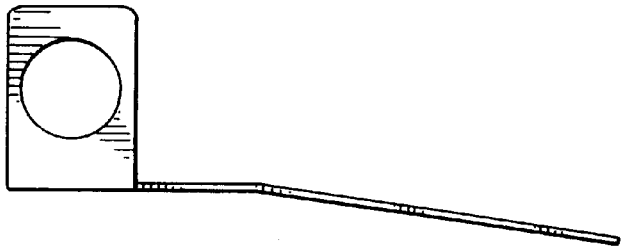
FIG. 10 is a side elevational view of the feeder spring guide component shown in FIGS. 8 and 9.
Figure 11:
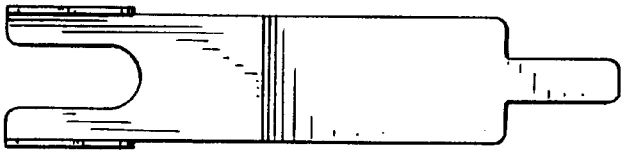
FIG. 11 is a bottom plan view of the feeder spring guide of FIG. 10.
Figure 12:
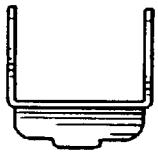
FIG. 12 is a rear elevational view of the feeder spring guide of FIG. 10.

FIGS. 10–12 illustrates in greater detail the feeder spring guide 81 that extends from the skimmer roller assembly 21 to the document feed mechanism nip area 58. As it was earlier pointed out, the purpose of the feeder spring guide is confining of the source document, and preventing the same from buckling or being damaged.

Figure 13:
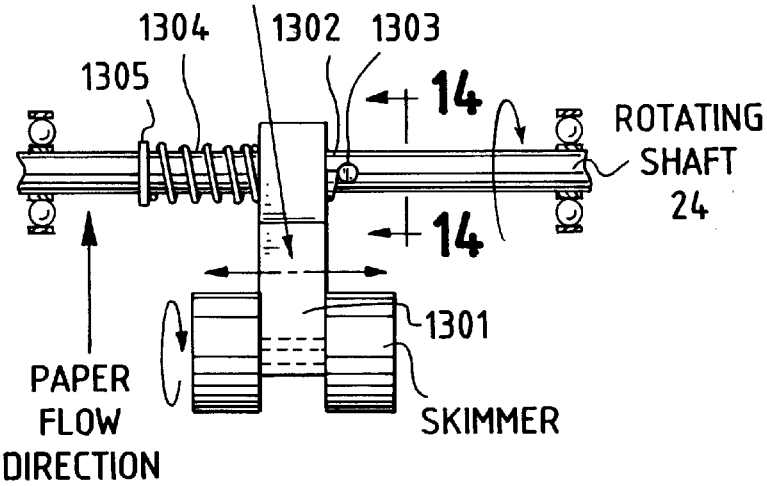
FIG. 13 is a top view of the skimmer assembly.
Figure 14:
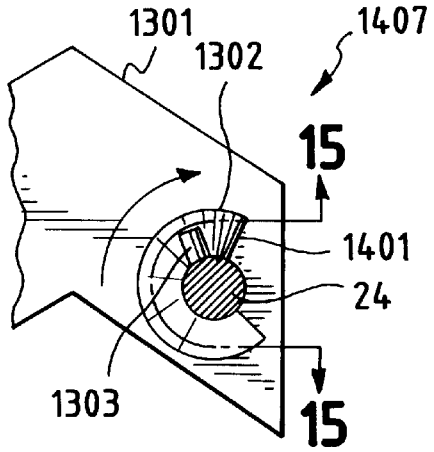
FIG. 14 is a section taken along lines 14—14 of FIG. 13, illustrating the lateral reciprocator.
Figure 15:
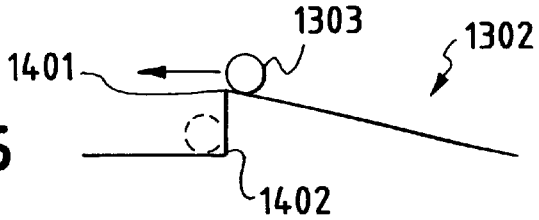
FIG. 15 is a section taken along lines 15—15 of FIG. 14, illustrating the cam.

FIGS. 13–15 show a schematic elevation view of an alternative skimmer assembly. A radial arm 1301 of the skimmer 21 is rotatably and slidably carried on the shaft 24 so the shaft 24 can rotate relative to the radial arm 1301. The radial arm 1301 has an annular cam surface 1302 protruding axially. The illustrated cam surface 1302 is a single saw-tooth extending 360 degrees about the shaft 24. The surface 1302 thus defines a gradual ramp extending around nearly the entire circumference, terminating at an apex 1401 representing its greatest axial projection, followed by a precipitous drop to a low point 1402 representing its least projection. More than one saw-tooth can be provided, if desired. For example, three 120- degree saw teeth or several saw teeth of different angular extents can be used. Other cam surface configurations and reciprocation patterns are also contemplated. For example, the cam surface could be arranged to reciprocate the cam follower in each direction at an equal rate, or dwell times could be incorporated between strokes of the reciprocating apparatus.

A cam follower 1303 is fixed to and rotates with the shaft 24 and is adjacent to the cam surface 1302. On the other side of the radial arm 1301, a compression spring 1304 is carried on the shaft 24 and is confined between a stop 1305 fixed to the shaft 24 and the radial arm 1301.

The cam follower 1303 rotates with the shaft 24, sliding along against the cam surface 1302, and causes the radial arm 1301 to move laterally in both directions. The radial arm 1301 moves laterally slowly to the left most of the time (as shown in FIG. 13). Once per revolution of the cam follower 1303, the radial arm 1301 jerks back suddenly to the right as the cam follwer 1303 passes from the apex 1401 of the cam surface (where the cam follower 1303 is shown in full lines in FIG. 15) to the lowest point 1402 of the cam surface surface (where the cam follower 1303 is shown in phantom lines in FIG. 15).

FIG. 14 is a side view taken along lines 14—14 of FIG. 13. The lateral reciprocator 1407 comprises the cam follower 1303 and the cam surface 1302. The cam follower 1303 rotates with the shaft 24 and slides along the cam surface 1302. FIG. 15 is a sectional view of the cam surface 1302 taken along lines 15—15 of FIG. 14.

Other reciprocation apparatus, such as a fluid drive, a crank, a servo drive, a linkage, or other like or unlike apparatus capable of causing reciprocation is also contemplated herein.

The periodic lateral jerk to the right (as shown in FIG. 13) of the skimmer 1301 allows for more reliable separation of the top sheet in the stack, as the lateral travel of the skimmer breaks the top sheet loose without advancing or retarding it in the feed direction (and potentially interfering with the operation of other apparatus).

Figure 16:
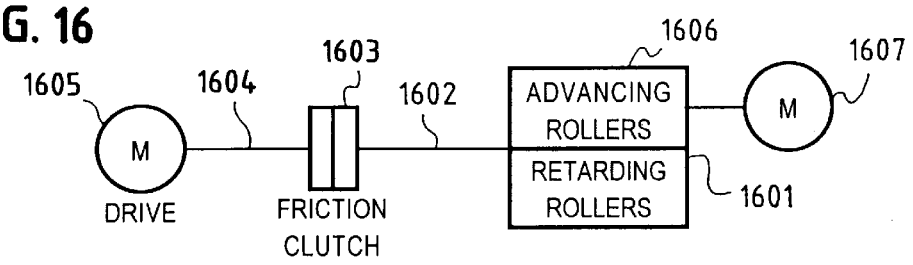
FIG. 16 is a block diagram of a retarding roller, a drive and a clutch.

Another alternative feature of the present sheet feeder is shown in FIGS. 16—20. FIG. 16 shows a block diagram of the relation between retarding rollers such as 1601, a driven shaft 1602, a friction clutch 1603, a drive shaft 1604, and a drive motor 1605. An advancing roller 1606 and its drive 1607 are also shown.

Figure 17:
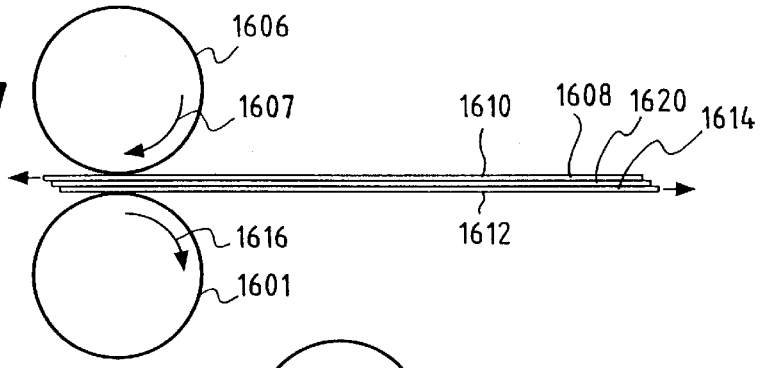
FIG. 17 is a diagrammatic view showing the operation of the advancing roller and retarding roller when a multifeed of more than two sheets is interposed between them.

Referring to FIGS. 16 and 17, the advancing roller 1606 is positioned to drive forward (by rotating in the direction of the arrow 1607) the first surface 1608 of a sheet 1610 in the sheet path defined between the rollers 1601 and 1606. The sheet 1610 is driven to the left, or forward, as a result. The retarding roller 1601 is positioned to drive back the second surface 1612 of a sheet 1614 in the sheet path (i.e. drive the sheet 1614 to the right in FIG. 17 by turning in the direction of arrow 1616). A drive 1605 is provided, tending to rotate the retarding roller 1601 backward. A friction clutch 1603 is provided to engage the drive 1605, via the shaft 1604, with the retarding roller 1601, via the shaft 1602.

Figure 19:
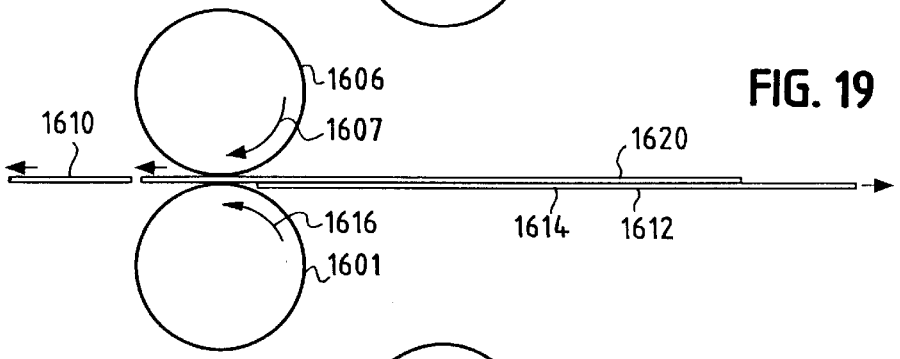
FIG. 19 is a view similar to FIG. 17 showing the operation of the advancing roller and retarding roller when a single sheet is interposed between them.

In operation, the clutch 1603 normally slips and permits the retarding roller 1601 to be driven forward by the advancing roller 1606 when one or no sheets such as 1610 are engaged between the advancing and retarding rollers 1606 and 1601 (as shown in FIG. 19, in which the reversing roller 1601 is driven forward, or in the direction of the arrow 1618 in FIG. 19). The clutch 1603 slips because the friction between either roller (1601, 1606) and the sheet 1610, or directly between the rollers 1601 and 1606, is great enough to make the clutch 1603 slip as the advancing roller 1606 drives the sheet 1610, which in turn drives the roller 1601 forward in the direction of the arrow 1618. This action drives the shaft 1602 of the retarding roller 1601 contrary to the drive direction of the shaft 1604 by the motor 1605. Since the shafts 1602 and 1604 are each driven with sufficient force in contrary directions, the clutch 1603 slips and uncouples them.

Figure 18:
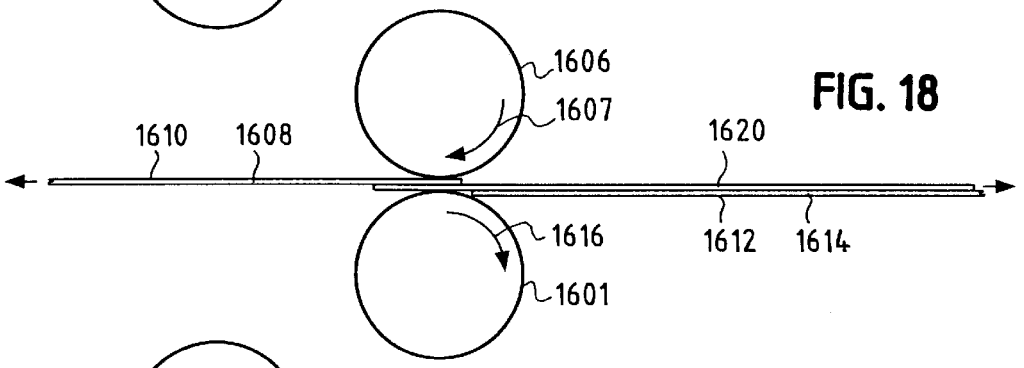
FIG. 18 is a view similar to FIG. 17 showing the operation of the advancing roller and retarding roller when a multifeed of two sheets is interposed between them.

The clutch 1603 engages and drives the retarding roller 1601 backward when a multifeed of two or more sheets is engaged by the advancing and retarding rollers 1606 and 1601. This situation is shown in FIGS. 17 (multifeed of three sheets), 18 (multifeed of two sheets), and 20 (multifeed of two sheets). The clutch 1603 engages when a multifeed enters because the sheet-to-sheet friction between two sheets interposed between the rollers 1601 and 1606, such as the sheets 1610 and 1614 in FIG. 18, is too low to cause the clutch 1603 to slip. More specifically, a pair of sheets 1610 and 1614 passed between the rollers 1601 and 1606 greatly reduces the driving force of the driving advancing roller 1606 on the formerly-driven retarding roller 1601. The shaft 1602 is not driven with much, if any, force by the retarding roller 1601. The shaft 1604 is driven in the retarding direction. Under these conditions the friction clutch 1603 does not slip, and the drive imparted by the input shaft 1604 drives the output shaft 1602, and thus the retarding roller 1601. The advancing roller thus engages and advances the top sheet such as 1610 and the retarding roller engages and retards the bottom sheet such as 1614 of a multifeed of two or more sheets.

Any sheets between the top sheet such as 1610 and bottom sheet such as 1614 of a multifeed, for example the sheet 1620 in FIG. 17, slips with respect both to sheets above and below. Depending on the exact circumstances, the middle sheets such as 1620 may be driven with little force in either direction, or may even remain stationary.

One particular advantage of this arrangement is that it can separate a multifeed of three or more sheets passed between the advancing and retarding rollers. The retarding roller drive can operate continuously (in one embodiemt of the invention). The friction clutch can remain engaged for as long as a multifeed of more than one sheet remains between the advancing and retarding rollers. The friction clutch remains engaged so long as a multifeed persists because sheet-to-sheet slippage between two or more sheets disengages the advancing roller from the retarding roller.

The retarding roller 1601 will retard the lowermost sheet of a multifeed the entire time the friction clutch is engaged. The retarding function will therefore continue to arrest or back up all the sheets but the top one (and particularly the lowermost sheet at any given moment, though intermediate sheets may also be driven back to some degree) until only the top sheet of the now-disassembled multifeed remains between the rollers. Only then does the advancing roller engage the retarding roller, thus disengaging the friction clutch, thus causing the retarding roller to rotate in a forward direction and pass the top sheet.

FIGS. 17–20 illustrate how a multifeed of three sheets is progressively broken down into individual sheets by the present separator. In FIG. 17, a multifeed including sheets 1610, 1620, and 1614 has been inserted between the advancing roller 1606 and the retarding roller 1601. The advancing roller 1606 drives the top sheet 1610 forward, as the friction between the top sheet 1610 and the roller 1606 is greater than the friction between the top sheet 1610 and middle sheet 1620 of the multifeed. The retarding roller 1601 drives the bottom sheet 1614 backward, as the friction between the bottom sheet 1614 and the roller 1601 is greater than the friction between the bottom sheet 1614 and the middle sheet 1620. Ideally, the middle sheet 1620 will remain essentially stationary, as the top sheet 1610 and the bottom sheet 1614 are sliding in opposite directions with about equal friction. This ideal condition will not be met, however, if the middle sheet 1620 is adhering or attracted more to one of the sheets 1610 and 1614 than to the other.

Since the top sheet 1610 is advancing, the bottom sheet 1614 is retreating, and the middle sheet 1620 moves very little, the multifeed is broken up first into three shingled sheets, as shown in FIG. 18. As illustrated, the top sheet 1610 and the middle sheet 1620 define a two-sheet multifeed at this point. The two-sheet multifeed is readily separated by the counterrotating advancing roller 1606 and retarding roller 1601, leading to the situation shown in FIG. 19. Here, the sheet 1610 is completely downstream of the separator made up of the rollers 1606 and 1601. The sheet 1620 which was next in the original stack is now the top sheet engaged between the rollers 1601 and 1606. The bottom sheet 1614 has been driven completely back out of the separator. Thus, the first sheet 1610 has been fully separated and advanced and the multifeed has been temporarily broken down to leave a single sheet 1620 between the rollers 1601 and 1606.

Once the multifeed has been reduced to a single sheet between the rollers 1601 and 1606, the single sheet 1620 is engaged with approximately equal friction by the rollers 1601 and 1606. The advancing roller 1606 is thus again able to drive the retarding roller 1601 forward, in the direction of the arrow 1618, causing the friction clutch 1603 to slip and thus eliminate the retarding action of the retarding roller 1601. The sheet 1620 advances at the rate dictated by the rotation of the advancing roller 1606.

Figure 20:
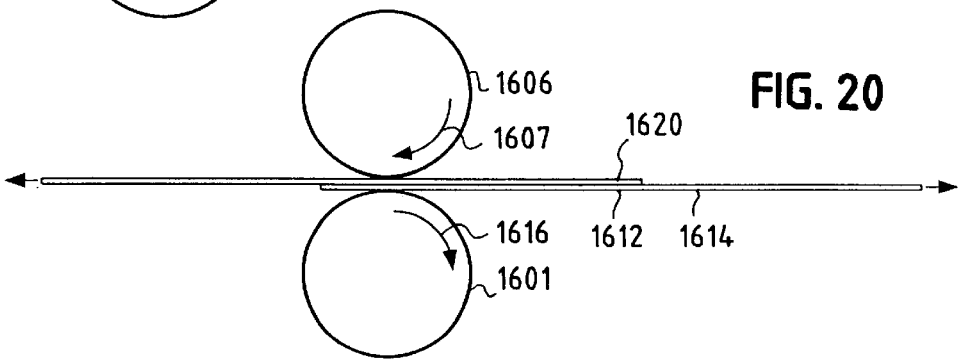
FIG. 20 is a view similar to FIG. 18 showing the operation of the advancing roller and retarding roller when a multifeed of two sheets is interposed between them.

If the sheets 1620 and 1614 again form a multifeed between the rollers 1601 and 1606, as shown in FIG. 20, the drive coupling between the rollers 1601 and 1606 is again broken by the interposition of two sheets, 1620 and 1614. The friction clutch 1603 again engages and the retarding roller 1601 is again driven backward, driving back the bottom sheet 1614.

The separator arrangement illustrated in FIGS. 16–20 can break down a multifeed of any number of sheets into individual sheets fed in the original sequence. This occurs because the uppermost sheets are driven forward in sequence (the top sheet of the multifeed first, then the second sheet of the multifeed when it becomes the top sheet, and so forth) and the lowermost sheets are driven backward in sequence (the bottom sheet of the multifeed first, then the second to bottom sheet once the bottom sheet is removed, and so forth). This action first shingles the sheets of the multifeed, then completely separates them into individual sheets. Although the foregoing detailed description of the present invention has been described by reference to a single exemplary embodiment, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein Consequently, the scope of the present invention is intended to be limited only by the attached claims.

What is claimed is:

1. A sheet separator, comprising:

(a) a sheet path along which a sheet having a first and second surfaces is passed;

(b) an advancing roller positioned to drive forward the first surface of a sheet in said sheet path;

(c) a retarding roller positioned to drive the second surface of a sheet in said sheet path;

(d) a drive for driving said retarding roller backward;

(e) a roller shaft on which said retarding roller is mounted in fixed relation, said roller shaft extending axially from said retarding roller; and (f) a friction clutch spaced from said retarding roller and connecting said drive with said roller shaft, said clutch permitting said retarding roller to be driven forward when fewer than two sheets are engaged between said advancing and retarding rollers, and said clutch permitting said retarding roller to be driven backward when two or more sheets are engaged by said advancing and retarding rollers.

2. The sheet separator according to claim 1, wherein said retarding roller is mounted to move toward and away from said advancing roller.

3. The sheet separator according to claim 2, wherein said retarding roller is biased against said advancing roller.

4. The sheet separator according to claim 3, wherein said retarding roller is biased against said advancing roller by a spring.

* * * * *